United States Patent [19]

Jartoux

[11] Patent Number: 4,628,649

[45] Date of Patent: Dec. 16, 1986

[54] CABLE ANCHORAGE DEVICES AND PROCESSES FOR FORMING SAME

[75] Inventor: Pierre Jartoux, Epernon, France

[73] Assignee: Freyssinet International, France

[21] Appl. No.: 748,467

[22] Filed: Jun. 25, 1985

[30] Foreign Application Priority Data

Jun. 27, 1985 [FR] France ..... 84 10158

[51] Int. Cl.[4] ..... E04C 3/10; B25G 3/20; F16B 2/00; F16G 11/00

[52] U.S. Cl. ..... 52/223 L; 52/230; 24/122.6; 24/136 R; 403/369

[58] Field of Search ..... 52/223 L, 230; 24/122.6, 136 R, 122.3; 403/368, 369, 12; 411/9, 10, 11

[56] References Cited

U.S. PATENT DOCUMENTS

| | | | |
|---|---|---|---|
| 3,412,511 | 11/1968 | Dietrich | 52/223 L |
| 3,524,228 | 7/1968 | Kelly | 403/369 |
| 3,820,832 | 6/1974 | Brandestini et al. | 52/223 L |
| 3,863,302 | 2/1975 | Welbergen et al. | 24/122.6 |
| 4,061,073 | 12/1977 | Easter et al. | 411/10 |
| 4,343,122 | 8/1982 | Wlodkowski | 52/223 L |

FOREIGN PATENT DOCUMENTS

| | | | |
|---|---|---|---|
| 973334 | 8/1975 | Canada | 52/230 |
| 900231 | 7/1962 | United Kingdom | 411/10 |

*Primary Examiner*—Carl D. Friedman
*Assistant Examiner*—John Malcolm White
*Attorney, Agent, or Firm*—Larson & Taylor

[57] ABSTRACT

The invention provides an anchorage device for a cable with multiple strands (2) comprising a block (1) in which the strands are anchored individually by radially clamping about each strand a split truncated cone shaped jaw (3) surrounding this strand and housed in a complementary housing (4) of the block. This device comprises a single thrust member (6) disposed axially opposite the different jaws (3) and a plurality of spacers (10) each interposed axially between said member (6) and a jaw (3) about the strand end (2) clamped by this jaw, said spacers (10) being identical to each other, formed from a metal or an alloy whose deformation/stress characteristic has a long plastic flow plateau and dimensioned so that at the end of the thrust the deformation of each of them has reached, but not exceeded, the plastic flow stage thereof.

6 Claims, 5 Drawing Figures

FIG.1.
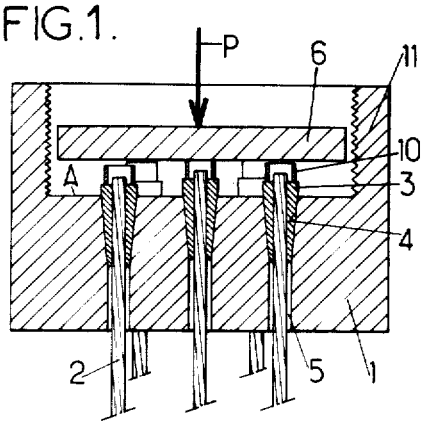
FIG.2.
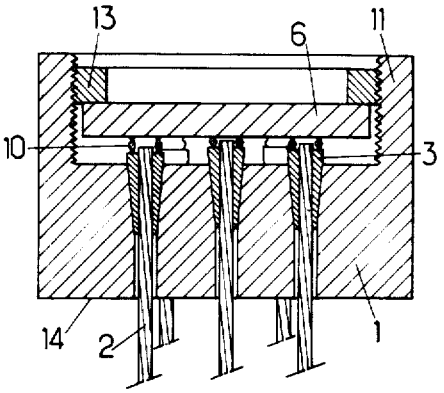
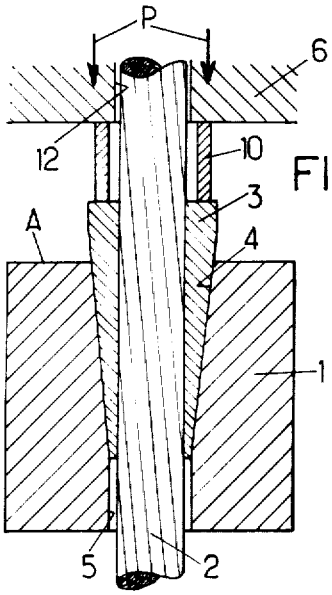
FIG.3.
FIG.4.
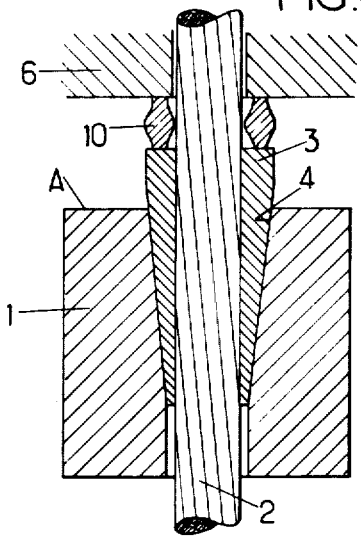
FIG.5.
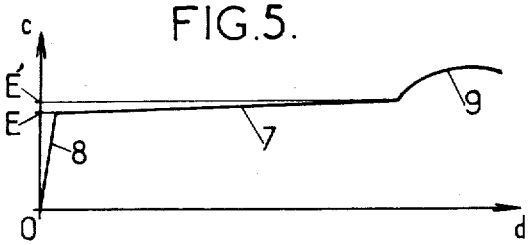

CABLE ANCHORAGE DEVICES AND PROCESSES FOR FORMING SAME

The invention relates to anchorage devices for cables formed of multiple strands, each strand being itself formed either by a wire or by several wires twisted together, said cables being intended to be tensioned, more particularly for prestressing a concrete body or for suspending a work such as a bridge (stays).

It also relates to the processes for forming the devices of the kind in question.

It relates more particularly, among these devices, to those in which the different strands of the cable are individually anchored in the same block by radially clamping about each of these strands a split truncated cone shaped jaw surrounding this strand and housed in a complementary recess in the block, the clamping in question being provided at least partially by application of an axial thrust on the large base of said jaw.

With known embodiments of the anchorage devices in question, the axial thrusts applied to the different jaws are generated individually.

In fact, it is scarcely possible to provide, with a single thrust member, clamping of identical intensity for the different jaws and strands of the same cable when the number of these strands is greater than three, as is the most general case in practice, said number generally exceeding ten and possible reaching, or even exceeding, a hundred or so: such a single member can in fact only be applied initially, i.e. before beginning to truly exert its thrust, at most to the three jaws which project axially the furthest from the anchorage block which jaws define the starting plane of the clamping.

Consequently, even though the other jaws are all reached subsequently by the thrust member, the total axial clamping travel is less than that of the first three jaws and the same goes for the resultant clamping forces.

The aim of the invention is especially to overcome this drawback by allowing clamping of identical intensity to be obtained on the different strands, in a very simple manner and with a single thrust member.

For this, the anchorage devices of the invention are characterized in that they comprise a single thrust member disposed axially opposite the different jaws and a plurality of spacers each interposed axially between said member and a jaw about the strand end clamped by this jaw, said spacers being identical to each other, made from a metal or an alloy whose deformation/stress characteristic has a long plastic flow plateau and are dimensioned so that at the end of the thrust the deformation of each of them has reached, but not exceeded, the stage of its plastic flow.

In preferred embodiments, recourse is further had to one and/or the other of the following arrangements:

the spacers are rings, the rings are tubular sections, the spacers are formed from soft steel, at the end of the thrust a stop rigidly secured to the anchorage block is held applied against the thrust member itself applied against the spacers, so as to prevent it from moving away from said block, the stop according to the preceding paragraph is an externally threaded ring screwed into an inner threaded sleeve containing the thrust member and integral with the anchorage block.

The invention will in any case be well understood from the complement of description which follows as well as the accompanying drawings, which complement and drawings have not limitative character.

FIGS. 1 and 2 of these drawings show schematically a device for anchoring a multistrand cable formed in accordance with the invention, respectively during formation thereof and after.

FIGS. 3 and 4 show on a larger scale a detail of this anchorage device, in respectively the same situations as in FIGS. 1 and 2.

FIG. 5 is a graph showing a property used in accordance with the invention.

It is desired to anchor to the same metal block 1 the parallel multiple strands 2, in number greater than three, forming a cable itself intended to be tensioned for forming for example a prestressed reinforcement for a concrete body or a suspension stay for a bridge.

In a way known per se, each strand is anchored to the block by means of a split truncated cone shaped jaw surrounding this strand and whose narrowest portion is housed in the complementary widened end 4 of a hole 5 formed in the block and through which the strand passes from one side to the other.

The widest end of each jaw 3 projects then axially from the face A of block 1 into which the widened ends 4 open, and the ends of strands 2 surrounded by the jaws themselves project axially from these widest ends.

Radial clamping of each jaw about the strand which it surrounds is provided by a wedge effect by urging this jaw into axial penetration in its housing.

In usual practice, this axial urging is generated by the tension of the strand itself because of the friction which exists between this strand and the internal face of the jaw.

In the present case, the tension of the cable may contribute to the axial urging of the jaw but it is not the essential cause thereof and this tension may even be zero during formation of the anchorage according to the invention, the cable only being tensiond during a subsequent phase.

Such a measure allows the firmness of the anchorage and the tension of the cable to be dissociated, which is precious in the cases where said tension may be considerably reduced, even cancelled out, during the very service of the cable: such a situation occurs for example when a suspended bridge stay receives a shock causes for example by an earthquake, by a tornado or by the loss of control of a heavy vehicle.

Here each jaw is urged into axial penetration by exerting an axial thrust on this jaw and with the invention the thrusts corresponding to the different jaws are provided by means of a single thrust member 6, even if the number of such jaws is greater than 3, which is the most general case, the only one considered here.

Considering the inevitable differences which exist betwen the dimensions of the strands 2, jaws 3 and housings 4, the heights corresponding to the respective axial projections of the different jaws 3 from face A are different.

If then the thrust member 6 were applied directly to these different jaws 3, it could only reach at most, among these jaws, before beginning to truly exert its thrust, the three jaws projecting furthest from face A.

The axial travel distances then imposed on these three jaws by member 6 would be longer than those imposed on the other jaws, the clamping intensities exerted on the different strands would therefore not be identical to each other and the overall tension exerted on the cable formed from these strands during its service could not be distributed uniformly between these strands, so that some of them would risk being over-tensioned whereas others, on the contrary, would be under-tensioned.

To overcome this disadvantage, the properties are used here which certain metals or alloys possess, such as soft steel, aluminium or copper alloys, of having a long plastic flow plateau 7 (FIG. 5) in the curve which represents their deformation under compression d (deformation expressed in shortening percentages) as a function of the stress C applied thereto. In other words, if we progressively increase said stress C, the deformation d is first of all very small and proportional to the stress (portion 8 of the curve). Then from the moment when stress C reaches a given threshold E, or elastic stress limit, the deformation d increases very rapidly for insignificant increases in stress C (plateau 7) until a new threshold E' is reached, or plastic flow limit, beyond which the stress C must be again substantially increased in order to increase the deformation d (portion 9 of the curve).

This property is used in the invention by interposing, between the thrust member 6 and the different jaws 3, spacers 10 made from such a metal or alloy, these spacers being chosen so that at the end of the thurst exerted by member 6, the deformation of each of them has reached, but not exceeded, the plastic flow stage.

This result assumes that at the end of the thrust;

shortening of the spacer placed against the jaw initially projecting furthest from face A is less than that corresponding to the plastic limit E', and that shortening of the spacer placed against the jaw projecting initially the least from face A is greater than that corresponding to the elastic stress limit E.

We can then be certain that the axial thrust forces p applied respectivly to the different jaws 3 are practically identical to each other and that consequently all the strands 2 are anchored in block 1 with the same clamping force.

Each of these thrusts p is in fact equal to the difference between the thrust P exerted by member 6 on each spacer 10 and the portion E, of this thrust P, required for partly crushing said spacer; now, each of the two values P and E is the same for all the spacers.

In the preferred embodiment, each spacer 10 is formed by a ring and preferably by a tube section and its plastic deformation causes it to bulge radially as can be seen in FIGS. 2 and 4.

It should be noted that each axial thrust force p exerted on a jaw 3 is strictly independent of the tension force exerted on the corresponding strand 2 and of the strength of this strand.

In particular, this thrust force p may be chosen greater than the maximum value of the tension force likely to be exerted during service on strand 2, the corresponding spacer 10 then of course being dimensioned accordingly; it is then certain that anchorage of the strand will be ensured whatever the magnitude of the fluctuations of the tension exerted on this strand during service, even if this tension is cancelled out.

It is advisable to hold the thrust member 6 in its end of thrust position so as to prevent the elastic return of the deformations generated in spacers 10 by said thrust and so as to keep the high value and the identity of the anchorage forces provided between the different strands 2 and block 1.

For this, this member 6—which is preferably formed from a thick plate, pierced with through or partial holes 12 for allowing the ends of strands 2 to pass so that these ends do not come into abutment against this plate—is advantageously housed inside an inwardly threaded sleeve 11 integral with block 1 and said member 6 is locked in this position by means of an externally threaded ring 13 (FIG. 2) bearing axially on this member and screwed into sleeve 11.

The force required for said holding in position is very small with respect to that required for exerting the above thrust P.

The assembly of elements 1, 3, 6, 10, 11 and 13 forms a monobloc anchorage head in which the different strands 2 are all firmly anchored with identical resistance to tearing away: it is this head which will then itself be anchored in the portions of works to be equipped, whereby it has all appropriate bearing surfaces 14.

As is evident, and as it follows moreover already from what has gone before, the invention is in no wise limited to those of its modes of application and the embodiments which have been more especially considered; it embraces, on the contrary, all variants thereof, more especially:

those in which preanchorage is formed between each strand 2 and block 1 by axially urging each jaw 3 to penetrate into its housing 4 by exerting a previous tension on the corresponding strand, the anchorages ensured by axial thrust on the different jaws in accordance with the present invention then being only anchorage complements provided more especially for safety purposes, the above stop piece 13 then becoming useless since there is no longer any risk of backward movement of the jaws, at the end of clamping, those in which the block in which the different strands 2 of the cable are anchored is not formed by a single element but by several elements superimposed in accordance with the teaching of patent No. FR 80 25 757 of the applicant.

I claim:

1. Device for anchoring a cable with multiple strands (2) comprising a block (1) in which these strands are anchored individually by radially clamping about each strand a split truncated cone shaped jaw (3) surrounding this strand and housed in complementary recess (4) of the block characterized in that it comprises a single thrust member (6) disposed axially opposite the different jaws (3) and a plurality of spacers (10) each interposed axially between said member (6) and a jaw (3) about the strand end (2) clamped by this jaw, said spacers (10) being identical to each other, formed from a metal or an alloy whose deformation/stress characteristic has a long plastic flow plateau and dimensioned so that at the end of the thrust, deformation of each of them has reached, but not exceeded, the plastic flow stage thereof.

2. Anchorage device according to claim 1, characterized in that the spacers (10) are rings.

3. Anchorage device according to claim 2, characterized in that the rings (10) are tubular sections.

4. Device according to claim 1, characterized in that the spacers (10) are formed from soft steel.

5. Anchorage device according to claim 1, characterized in that a stop (13) rigidly connected to the anchorage block (1) is held against the thrust member (6) itself applied against the spacers (10) so as to prevent if from moving away from said block.

6. Device according to claim 5, characterized in that the stop (13) is an externally threaded ring screwed into an internally threaded sleeve (11) containing the thrust member (6) and integral with the anchorage block (1).

* * * * *